US008950598B2

(12) United States Patent
Hsieh

(10) Patent No.: US 8,950,598 B2
(45) Date of Patent: Feb. 10, 2015

(54) HANGING CLIP FOR TOOLS

(76) Inventor: Chih-Chien Hsieh, Taichung (TW)

( * ) Notice: Subject to any disclaimer, the term of this patent is extended or adjusted under 35 U.S.C. 154(b) by 342 days.

(21) Appl. No.: 13/495,506

(22) Filed: Jun. 13, 2012

(65) Prior Publication Data

US 2013/0334149 A1 Dec. 19, 2013

(51) Int. Cl.
*A47F 7/00* (2006.01)
*B65D 85/28* (2006.01)

(52) U.S. Cl.
USPC ..... 211/70.6; 206/373

(58) Field of Classification Search
USPC ..... 211/70.6; 206/45.23, 349, 372, 373, 206/374, 375, 376, 377, 378
See application file for complete search history.

(56) References Cited

U.S. PATENT DOCUMENTS 5,425,519 A * 6/1995 Budert ..... 248/214
5,740,911 A * 4/1998 Chou ..... 206/378
5,862,913 A * 1/1999 Chou ..... 206/378
5,975,297 A * 11/1999 Kao ..... 206/378
6,315,119 B1 * 11/2001 Lee ..... 206/349
6,415,933 B1 * 7/2002 Kao ..... 211/70.6
6,494,329 B1 * 12/2002 Dembicks ..... 211/70.6
6,508,360 B1 * 1/2003 Chen ..... 206/378
6,669,032 B2 * 12/2003 Kao ..... 211/70.6
6,672,555 B2 * 1/2004 Chang ..... 248/317
7,121,031 B2 * 10/2006 Wheeler ..... 40/673
7,287,644 B2 * 10/2007 Chen ..... 206/378
8,261,912 B1 * 9/2012 Ingrey-Senn ..... 206/378
8,381,920 B2 * 2/2013 Chang ..... 211/70.6
2007/0114148 A1 * 5/2007 Wheeler et al. ..... 206/349
2007/0267307 A1 * 11/2007 Chang ..... 206/376
2012/0031789 A1 * 2/2012 Chang ..... 206/349

* cited by examiner

*Primary Examiner* — Patrick Hawn
(74) *Attorney, Agent, or Firm* — Egbert Law Offices, PLLC

(57) ABSTRACT

A hanging clip for tools includes a hanging clip body, a sleeving portion, a connecting portion, support limiting flanges, a flexible sheet, a positioning bulge and a male/female clamping part. The sleeving portion is directly extended to the bottom end of the hanging clip body. The flexible sheet is unfolded and extended downwards to the connecting portion and comprises of an inner surface, an outer surface, an extended end and a folded flange. The sheet could be unfolded and extended downwards via said folded flange, or bent and retracted upwards to form a columnar pattern together with the sleeving portion. The sleeving portion and flexible sheet are pre-fabricated and when the sleeving portion and flexible sheet are in service state, two vertical limiting walls of the sleeving portion could be supported via the support limiting flanges, thus saving manufacturing cost and enhancing the structural strength for excellent anti-theft functions.

5 Claims, 9 Drawing Sheets

HANGING CLIP FOR TOOLS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a hanging clip for tools, and more particularly to an innovative one of simple construction and strong structural strength.

2. Description of Related Art Including Information Disclosed Under 37 CFR 1.97 and 37 CFR 1.98.

Tool accessories (e.g.: sleeves and connecting rods) are common products sold in hardware shops. For example, hanging clips for tools are often coupled with sleeves, which are then placed on shelves for the purpose of a well-arranged display and purchase. Yet, in view of endless theft phenomenon in society, anti-theft monitors are often installed in common hardware shops, but some dead corners cannot be covered by them, and sleeves could be easily disengaged by the thieves from the hanging clips. Hence, an anti-theft hanging clip for tools has been developed accordingly.

Notwithstanding a variety of anti-theft hanging clips for tools, the excessive complex components will lead to inconvenient assembly and higher manufacturing cost. For example, a conventional anti-theft hanging clip for tools structurally comprises: a clip body, an embedding member, of which male and female assembly portions are set correspondingly to the embedding member and clip body. When the sleeve is sleeved onto the clip body, the embedding member could be buckled onto the clip body by the male and female assembly portions, and said sleeve is also limited between the embedding member and clip body for guarding against theft. The aforementioned elements are separately fabricated and then assembled by buckling, so the excessive complex components will lead to inconvenient use or assembly and higher manufacturing cost.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the innovative design of the present invention wherein the "hanging clip for tools" mainly comprises: a hanging clip body, at least a sleeving portion, a connecting portion, support limiting flanges, a flexible sheet, at least a positioning bulge and a male/female clamping part, the present invention allows the sleeving portion and flexible sheet to be pre-fabricated. When the sleeving portion and flexible sheet are in a service state, two vertical limiting walls of the sleeving portion could be supported outwards via the support limiting flanges, thus saving the manufacturing cost and enhancing the structural strength for excellent anti-theft functions.

Besides, a first reinforced piece body is set between two vertical limiting walls and onto different locations of the connecting portion. A hollow portion is locally formed into the first reinforced piece body, and a protruding block is set onto the inner surface of the flexible sheet correspondingly to the hollow portion. When the flexible sheet and sleeving portion form a columnar body, the protruding block is abutted closely into the hollow portion, such that the first reinforced piece body along with two vertical limiting walls could be supported outwards to increase the overall structural strength.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
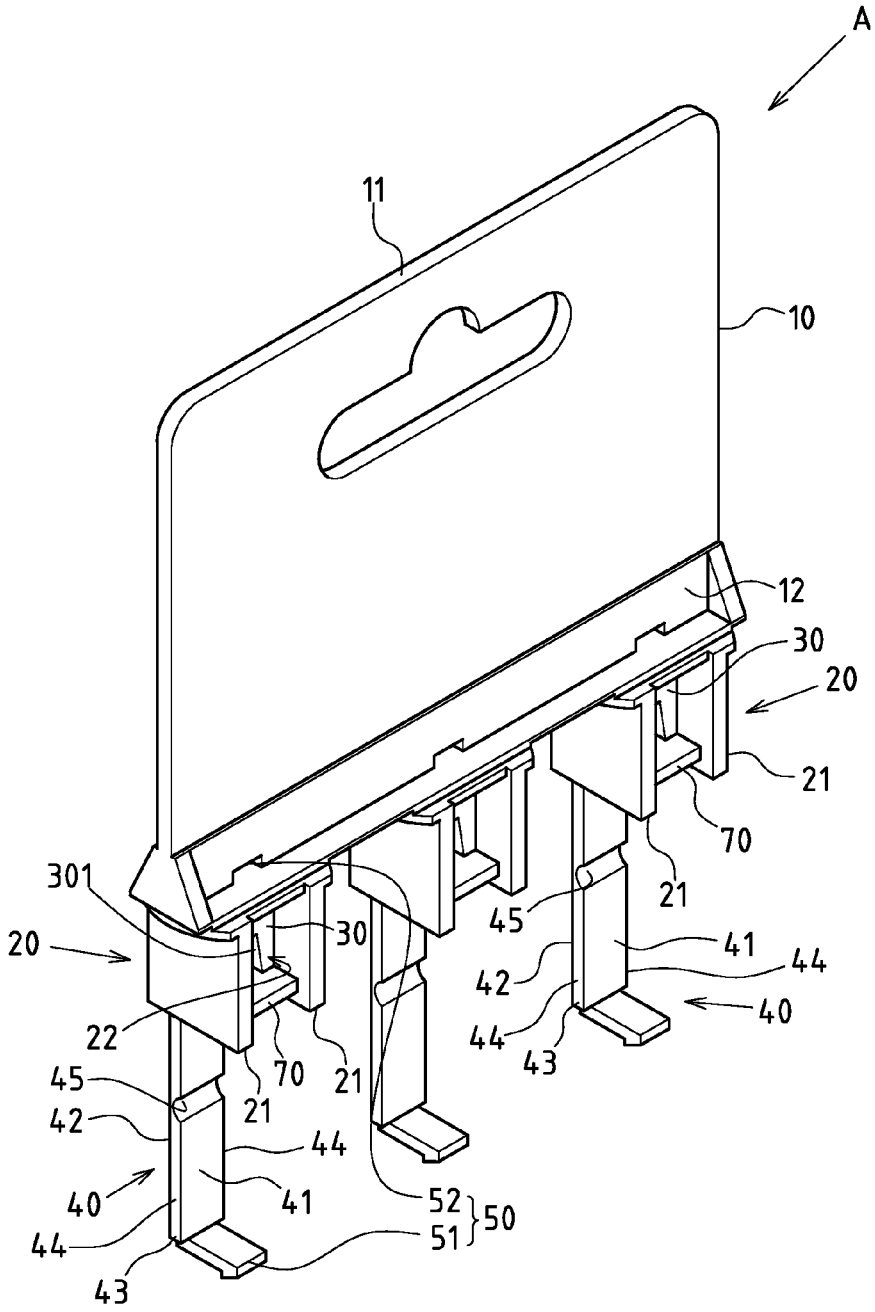
FIG. 1 is a perspective view of the present invention wherein the hanging clip for tools is prefabricated.
Figure 2:
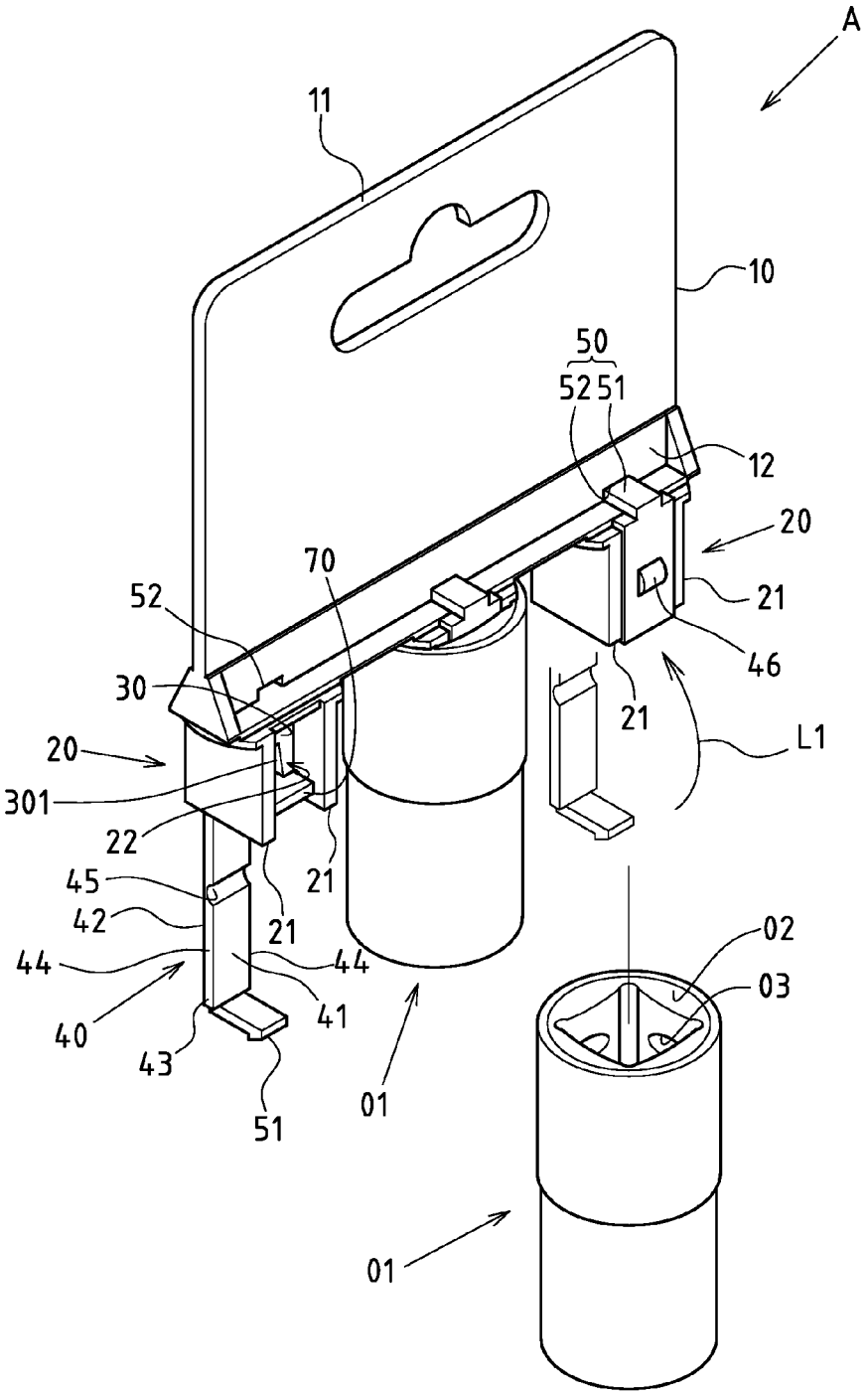
FIG. 2 is a perspective view of the present invention wherein the hanging clip for tools is in a service state.
Figure 3:
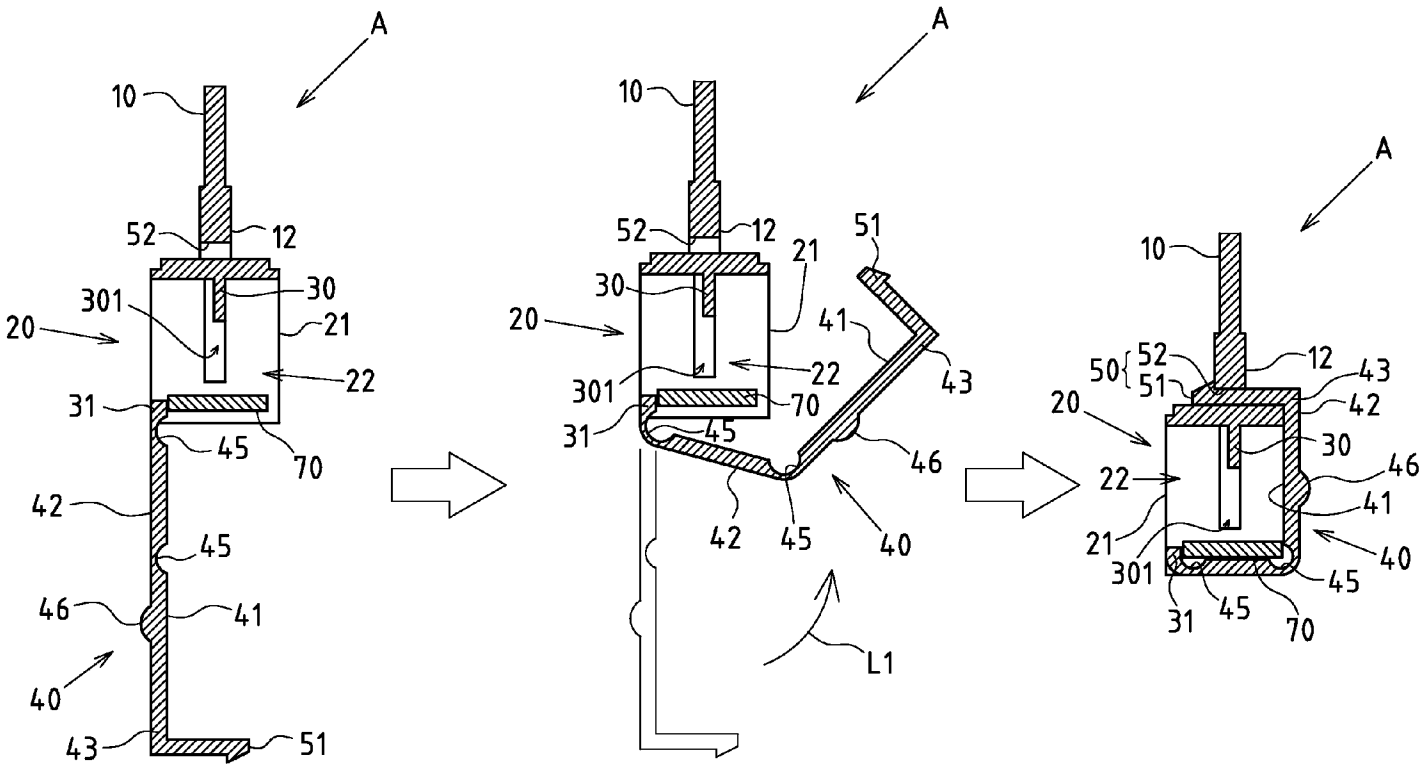
FIG. 3 is a schematic view of the present invention wherein the flexible sheet is bent and retracted upwards to form a columnar pattern together with the sleeving portion.

FIGS. 1-3 depict preferred embodiments of the hanging clip for tools of the present invention, which, however, are provided for only explanatory objective for patent claims. Said anti-theft hanging clip A for tools is used for sleeving and positioning of the tool 01 with trough 02. The trough 02 contains at least a positioning concave rim 03.

The hanging clip A for tools comprises a hanging clip body 10, comprising of a top end 11 and a bottom end 12. At least a sleeving portion 20 is extended directly to the bottom end 12 of the hanging clip body 10. Said sleeving portion 20 comprises of two vertical limiting walls 21 arranged at interval and a partitioned space 22 formed between two vertical limiting walls 21.

A connecting portion 31 is connected transversely onto two vertical limiting walls 21.

Figure 4:
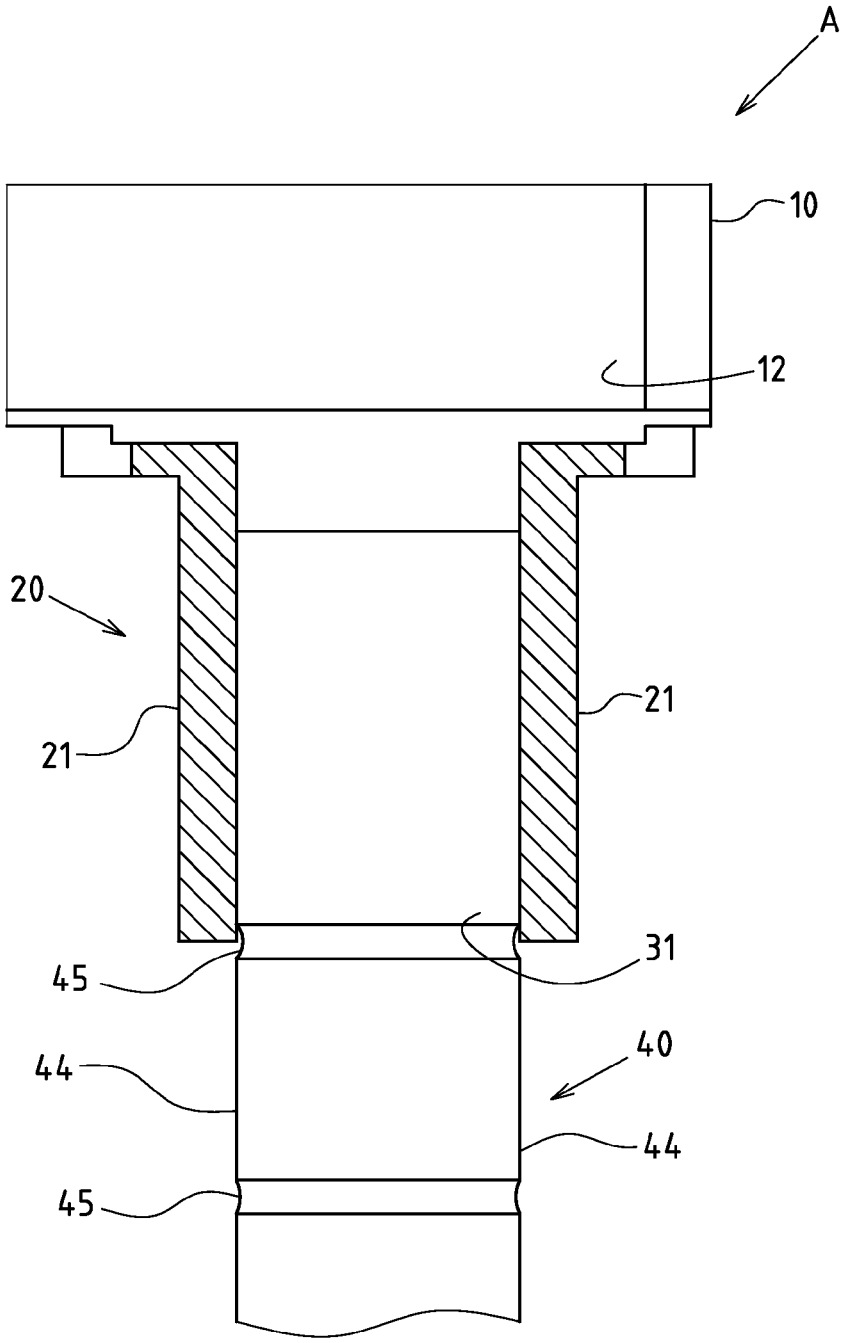
FIG. 4 is a schematic view of the present invention wherein the connecting portion is extended upwards into a sheet pattern.

Referring to FIG. 3, the connecting portion 31 in rod-like pattern is connected to the bottom end of two vertical limiting walls 21. Referring also to FIG. 4, the rod-like connecting portion 31 is extended upwards into a sheet pattern.

Figure 9:
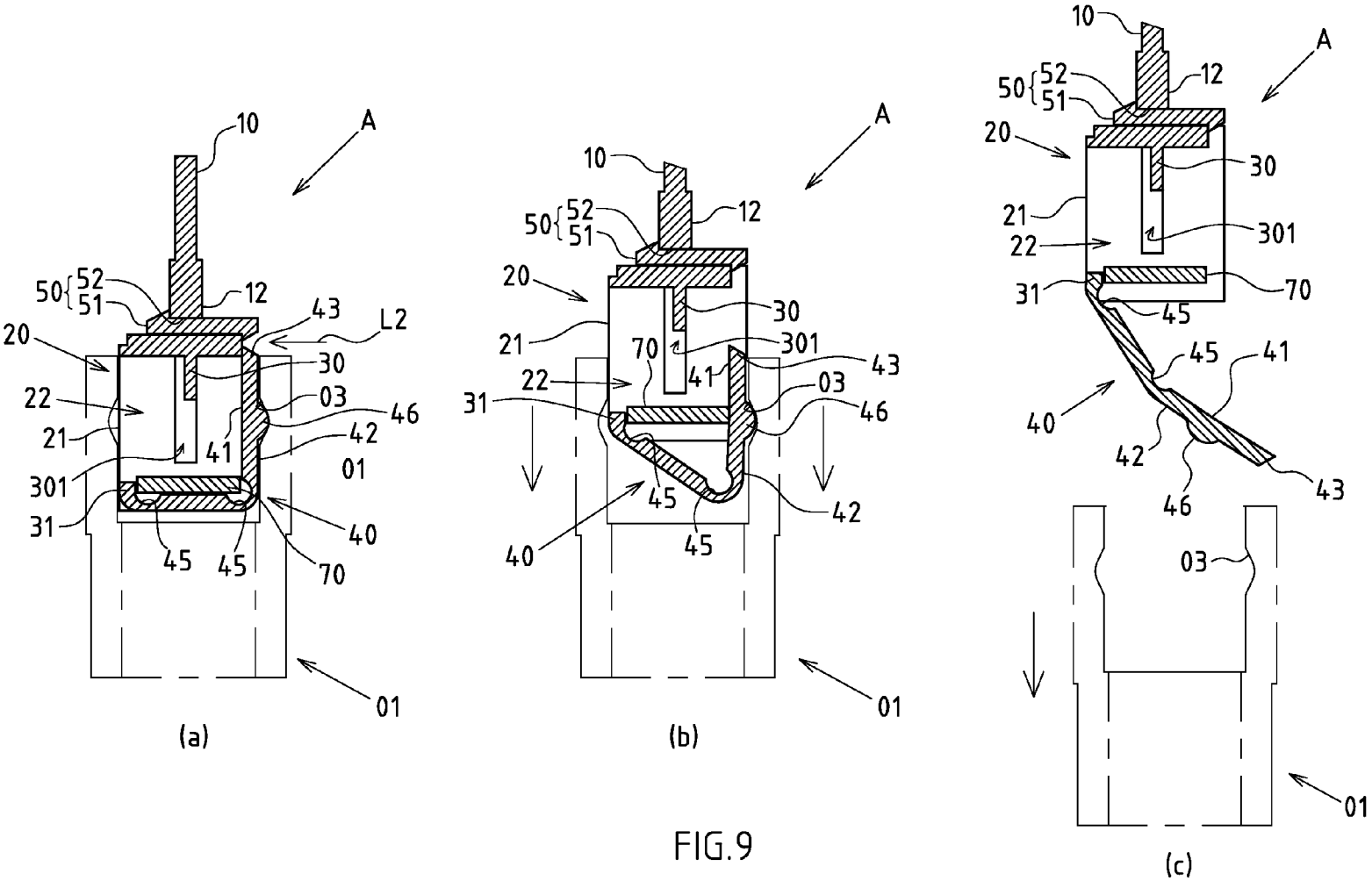
FIG. 9 is a schematic view of the present invention wherein the tool is taken out after anti-theft state is removed.

A flexible sheet 40 is unfolded and extended downwards to the connecting portion 31 (shown in FIGS. 3, 9). It comprises of an inner surface 41, an outer surface 42, an extended end 43 and two folded flanges 45. So, the flexible sheet 40 could be unfolded and extended downwards via said folded flange 45 (shown in FIG. 1), or bent and retracted upwards to form a columnar pattern together with the sleeving portion 20 (shown in FIG. 2).

Figure 5:
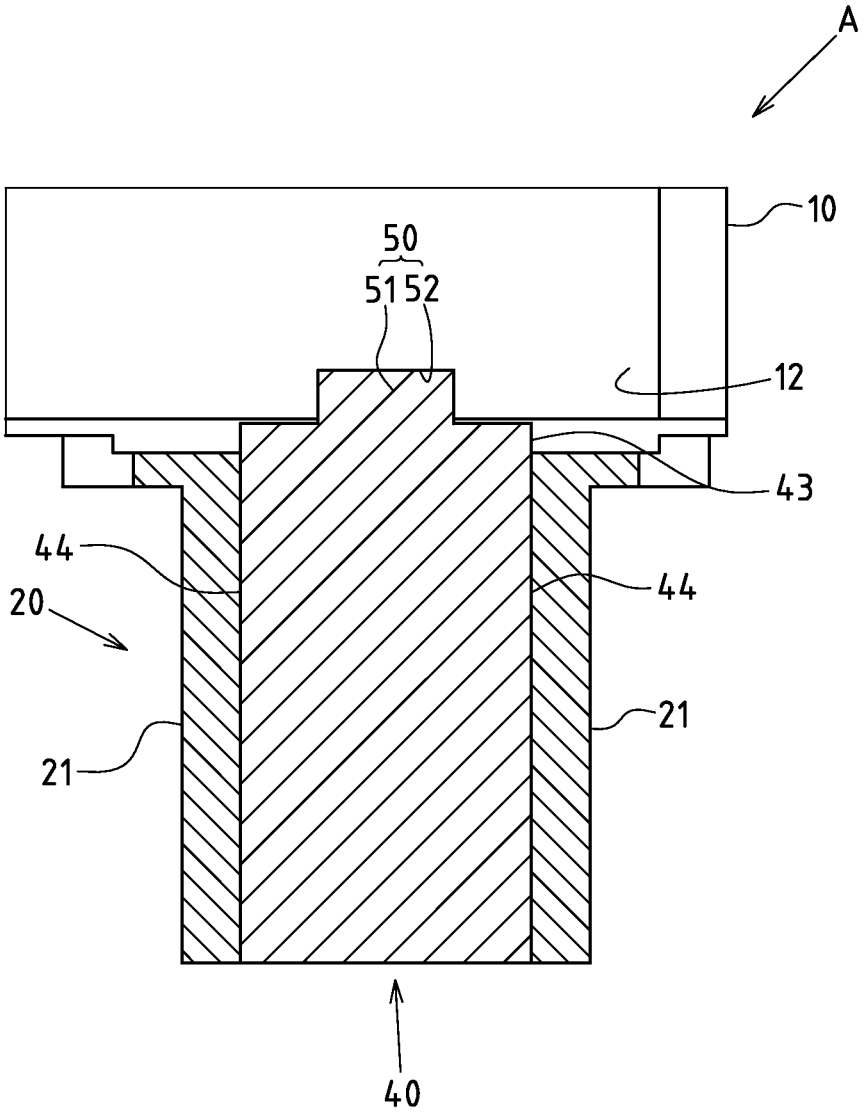
FIG. 5 is a schematic view of the present invention wherein the support limiting flanges are abutted closely onto the inner side of two vertical limiting walls.

Support limiting flanges 44 are formed at two sides of the flexible sheet 40. When the flexible sheet 40 and sleeving portion 20 form a columnar body, two vertical limiting walls 21 are supported outwards via the support limiting flanges 44. Referring to FIG. 5, said support limiting flanges 44 are abutted closely onto inner side of two vertical limiting walls 21, so that two vertical limiting walls 21 are supported outwards for limitation.

Figure 6:
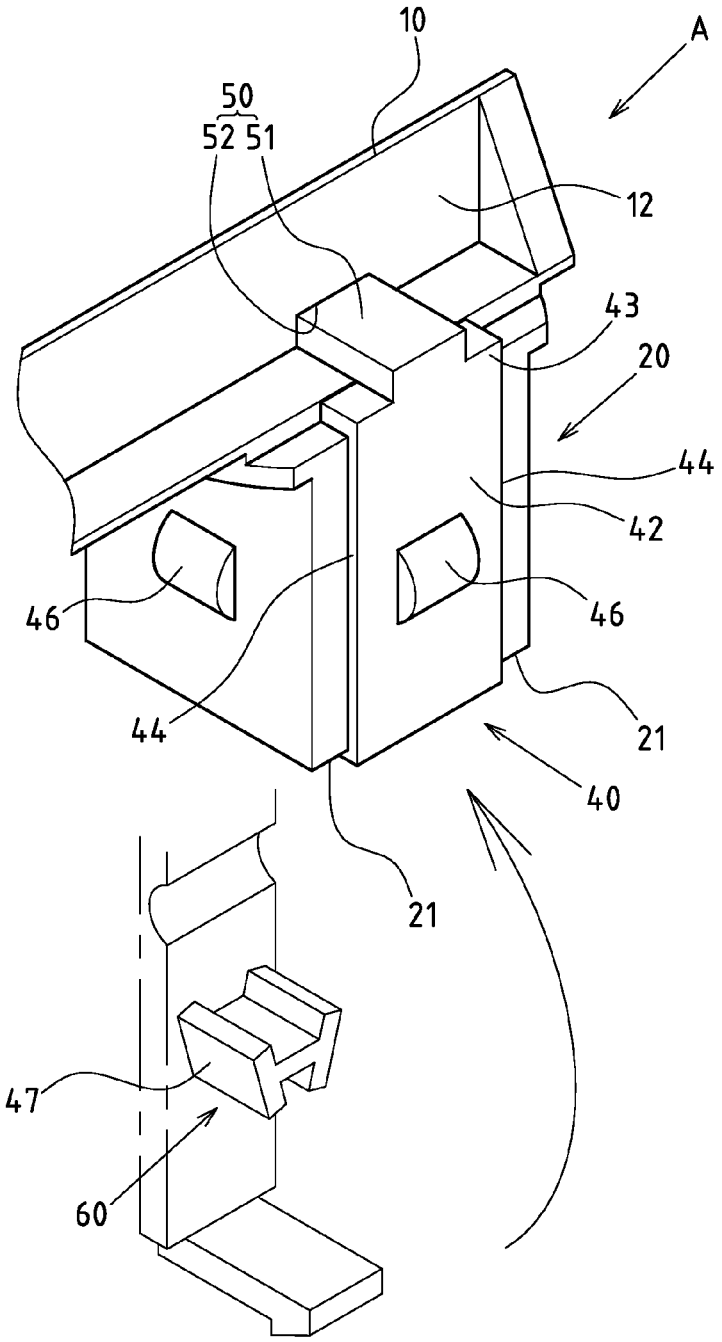
FIG. 6 is a schematic view of the present invention wherein the protruding block is set directly onto inner surface of the flexible sheet.

At least a positioning bulge 46 is set on the outer surface 42 of the flexible sheet 40 adjacent to the extended end 43, or at least one location on the external side of the vertical limiting walls 21. Said positioning bulge 46 could be engaged securely with the positioning concave rim 03 of the tool 01 when the tool 01 is sleeved onto the sleeving portion 20. Referring to FIGS. 3 and 9, said positioning bulge 46 is only set on the outer surface 42 of the flexible sheet 40 adjacent to the extended end 43. Referring to FIG. 6, said positioning bulge 46 is set on the outer surface 42 of the flexible sheet 40 adjacent to the extended end 43 and also on the external side of the vertical limiting walls 21.

A male/female clamping part 50 is set directly onto the extended end 43 of the flexible sheet 40 and the hanging clip body 10. The flexible sheet 40 and sleeving portion 20 in service state can be positioned securely by the male/female clamping part 50. Referring to FIGS. 2 and 3, the male/female clamping part 50 comprises of an inserting piece 51 set at the extended end 43 of the flexible sheet 40 and a through-hole 52 set at the bottom end 12 of the hanging clip body 10 correspondingly to the inserting piece 51.

Figure 7:
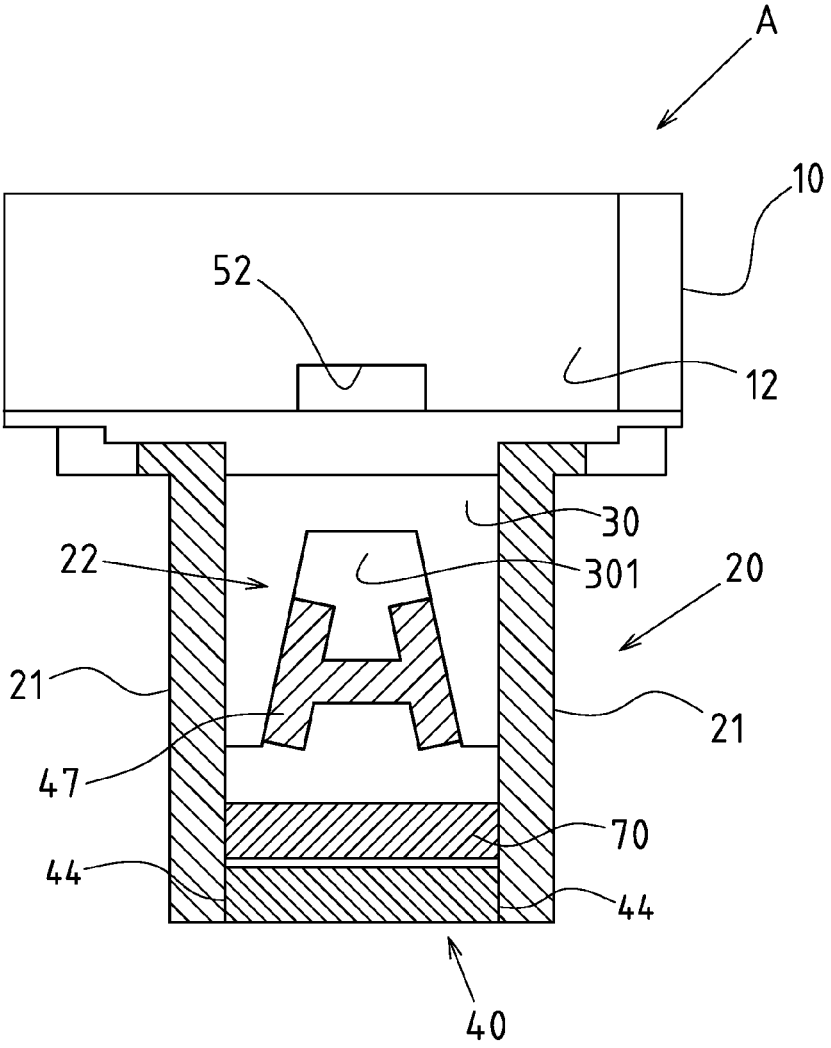
FIG. 7 is a schematic view of the present invention wherein the protruding block is abutted closely into the hollow portion when the hanging clip for tools is in service state.

Referring to FIG. 7, a first reinforced piece body 30 is set between said two vertical limiting walls 21 and onto different locations of the connecting portion 31. A hollow portion 301 is locally formed into the first reinforced piece body 30, and a protruding block 47 is set onto the inner surface 41 of the flexible sheet 40 correspondingly to the hollow portion 301 (shown in FIG. 6). When the flexible sheet 40 and sleeving portion 20 form a columnar body, the protruding block 47 is abutted closely into the hollow portion 301, such that the first reinforced piece body 30 along with two vertical limiting walls 21 could be supported outwards to increase the overall structural strength.

Referring to FIG. 3, a second reinforced piece body 70 is set at a spacing below the first reinforced piece body 30. The second reinforced piece body 70 is connected directly between two vertical limiting walls 21.

The present invention is operated as follows:

Referring to FIG. 1, said flexible sheet 40 and sleeving portion 20 are pre-fabricated, and prior to use, the flexible sheet 40 is extended downwards. When the user intends to assemble the tool 01, referring to FIGS. 2 and 3, the flexible sheet 40 is bent and retracted upwards (indicated by arrow L1 in FIGS. 2, 3), and constructed into a columnar body together with the sleeving portion 20, and then positioned securely by engagement with the male/female clamping part 50. In such case, the user could allow the tool 01 to be sleeved onto the sleeving portion 20. As compared with prior art, the present invention's sleeving portion 20 and flexible sheet 40 are pre-fabricated, providing users with advantages such as: simple construction, more convenient assembly and lower manufacturing cost. Another technical characteristic of the present invention lies in that when the flexible sheet 40 is bent and retracted upwards to form a columnar body together with the sleeving portion 20, two vertical limiting walls 21 could be supported outwards via the support limiting flanges 44 (shown in FIG. 5), thus enhancing the structural strength to avoid disengagement of the tool 01 for excellent anti-theft functions.

Figure 8:
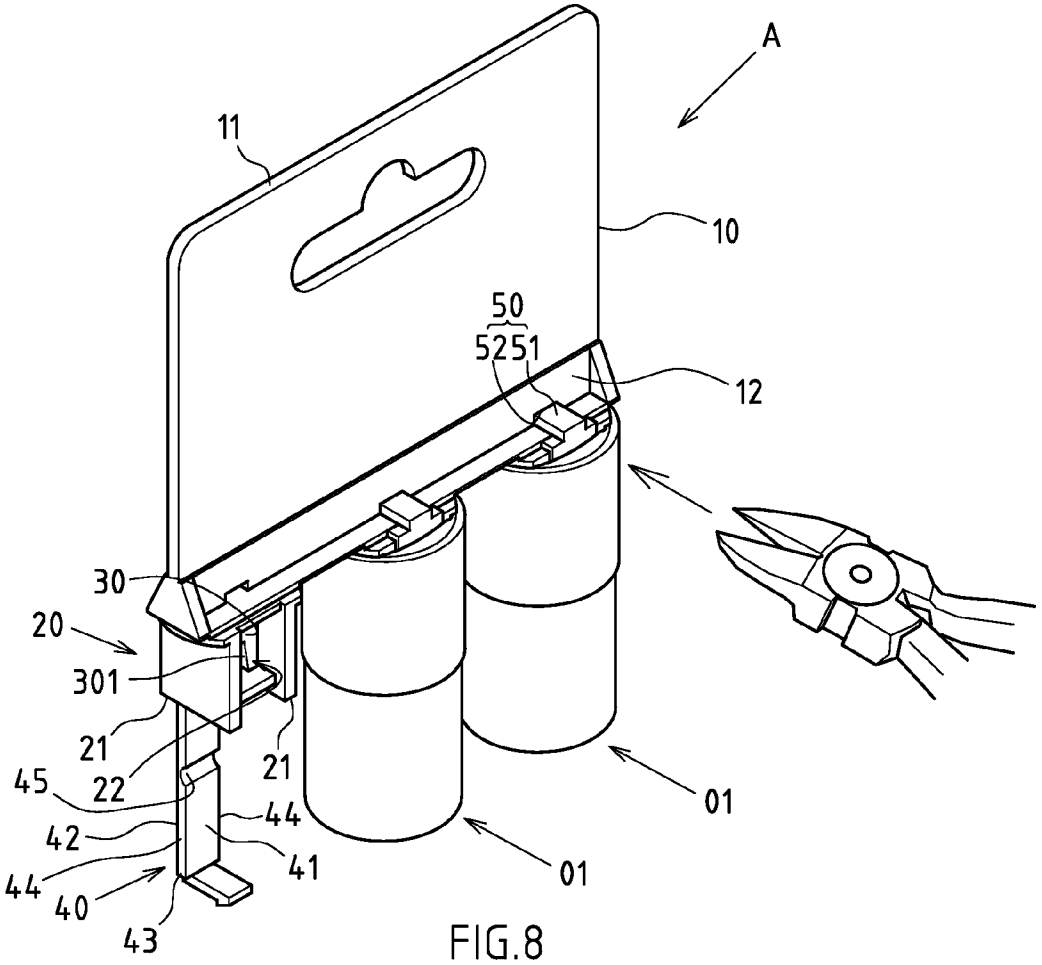
FIG. 8 is a schematic view of the present invention wherein anti-theft status is removed by a shear.

Referring to FIG. 8, if the user intends to separate the tool 01 from the sleeving portion 20, the flexible sheet 40 must be cut off by a shear. Referring to FIG. 9 (*a*), the user could cut off the flexible sheet 40 to expose the tool 01 (indicated by arrow L2). Then referring to FIG. 9 (*b*), the tool 01 is pulled downwards, and the positioning bulge 46 is hooked by the positioning concave rim 03 of the tool 01, so that the flexible sheet 40 will zigzag downwards, allowing to take out smoothly the tool 01 (shown in FIG. 9 (*c*)).

I claim:

1. A hanging clip apparatus for sleeving and positioning of a tool, the tool having a trough containing at least one positioning concave rim, the hanging clip apparatus comprising:

a hanging clip body having a top end and a bottom end;

at least one sleeving portion extends directly toward the bottom of the hanging clip body, the sleeving portion comprising a pair of vertical limiting walls in spaced relation to each other and having a partitioned space therebetween;

a connecting portion connected transversely to said pair of vertical limiting walls;

a flexible sheet unfolded and extending downwardly from said connecting portion, said flexible sheet having an inner surface and an outer surface and an extended end and at least one folded flange, said flexible sheet being unfolded and extended downwardly via said folded flange, said flexible sheet suitable for bending and retracting upwardly to form a columnar body corresponding to said sleeving portion;

a plurality of support limiting flanges formed at a pair of sides of the flexible sheet, said pair of vertical limiting walls being supported outwardly by said plurality of support limiting flanges when said flexible sheet and said sleeving portion form the columnar body;

at least one positioning bulge positioned on said outer surface of the flexible sheet adjacent said extended end or positioned on at least one location on the external side of said pair of vertical limiting walls, the positioning bulge engageable securely with the positioning concave rim of the tool when the tool is sleeved onto the sleeving portion; and a male/female clamping portion set onto said extended end of the flexible sheet and the lower end of the hanging clip body, said flexible sheet and sleeving portion positionable securely by said male/female clamping portion.

2. The hanging clip apparatus of claim 1, further comprising:

a first reinforced piece body positioned between said pair of vertical limiting walls and onto different locations of said connecting portion.

3. The hanging clip of claim 2, said first reinforced piece body having a hollow portion formed therein, said flexible sheet having a protruding block positioned onto said inner surface thereof corresponding to said hollow portion, said protruding block abutting into said hollow portion when said flexible sheet and said sleeving portion form the columnar body that is positioned securely by said male/female clamping portion.

4. The hanging clip of claim 2, further comprising:

a second reinforced piece body positioned at and spaced below said first reinforced piece body, said second reinforced piece body connected directly between said pair of vertical limiting walls.

5. The hanging clip of claim 1, said male/female clamping portion comprising an inserting piece positioned at said extended end of said flexible sheet and positioned at a through hole positioned at said bottom end of said hanging clip body.

* * * * *